US007455469B1

(12) United States Patent
Langdon

(10) Patent No.: US 7,455,469 B1
(45) Date of Patent: Nov. 25, 2008

(54) APPARATUS FOR APPLYING PAINT

(76) Inventor: Ronald Wayne Langdon, 111 Portman Rd., Leitchfield, KY (US) 42754

( * ) Notice: Subject to any disclaimer, the term of this patent is extended or adjusted under 35 U.S.C. 154(b) by 462 days.

(21) Appl. No.: 11/306,118

(22) Filed: Dec. 16, 2005

Related U.S. Application Data

(60) Provisional application No. 60/652,077, filed on Feb. 11, 2005.

(51) Int. Cl.
*B43M 11/02* (2006.01)
*A47L 1/08* (2006.01)

(52) U.S. Cl. ..... 401/219; 401/136; 401/137

(58) Field of Classification Search ..... 401/136, 401/137, 188 R, 191, 208, 219, 289
See application file for complete search history.

(56) References Cited

U.S. PATENT DOCUMENTS

| | | | | |
|---|---|---|---|---|
| 1,918,519 | A | 7/1933 | Clements | |
| 2,488,655 | A | 11/1949 | Bennett | |
| 2,710,207 | A | 6/1955 | Mueller | |
| 3,331,093 | A | 7/1967 | Mayden | |
| 3,340,562 | A | 9/1967 | Skandaliaris | |
| 3,427,115 | A | 2/1969 | Jolly | |
| 4,013,225 | A | 3/1977 | Davis | |
| 4,059,358 | A | 11/1977 | Arai | |
| 4,551,037 | A | 11/1985 | Kille et al. | |
| 4,761,092 | A | 8/1988 | Nakatani | |
| 5,595,451 | A | 1/1997 | Harrison, Jr. | |
| 5,853,258 | A * | 12/1998 | Woodruff | 401/219 |
| 6,142,699 | A | 11/2000 | Pao | |
| 6,267,528 | B1 | 7/2001 | Higashino | |
| 6,540,430 | B2 | 4/2003 | Hsu | |
| 6,619,569 | B2 | 9/2003 | Jens | |
| 6,860,669 | B2 | 3/2005 | Laisement et al. | |
| 6,908,249 | B2 | 6/2005 | Tomm | |
| 2007/0122227 | A1 * | 5/2007 | Davis | 401/137 |

FOREIGN PATENT DOCUMENTS

| | | |
|---|---|---|
| CH | 427 587 | 6/1967 |

* cited by examiner

*Primary Examiner*—David J Walczak
(74) *Attorney, Agent, or Firm*—Camoriano and Associates; Theresa Fritz Camoriano; Guillermo Camoriano

(57) ABSTRACT

An apparatus for applying a fluid, such as paint, to a surface. The apparatus includes an adjustable spray nozzle which can be adjusted both in position and in direction, allowing the fluid to be sprayed either onto a roller or directly onto another surface or both.

7 Claims, 6 Drawing Sheets

17
18
19B
19D
19B
19C
19A
19E 19C
19A
19
3A
3A
B
19E 16
15
10
20
21
13

APPARATUS FOR APPLYING PAINT

BACKGROUND

This application claims priority from U.S. Provisional Application Ser. No. 60/652,077, filed Feb. 11, 2005. The present invention relates to an apparatus for applying a fluid to a surface. Various devices are known, such as paint sprayers and paint rollers. However, many of these devices have problems or are not adaptable to the typical variety of tasks that must be performed in a typical painting situation. For example, in the case of paint sprayers that use flexible hose lines, the sprayer typically drips when the valve is shut off and the hose returns to its unpressurized state. In the case of sprayers that spray onto rollers, it can be difficult to convert from spraying onto the roller to spraying directly onto the surface, and it can be difficult to adjust the spray so that it just covers the roller without leaving dry spots or overspraying beyond the roller.

SUMMARY

The present invention provides an apparatus that includes a spray nozzle and a roller, with the spray nozzle being readily movable from a position in which it sprays directly onto the roller to a position in which it sprays directly onto the surface to be coated. It also includes adjustments that allow the painter to ensure that, when the spray nozzle is spraying onto the roller, it can be adjusted to just cover the roller, without leaving dry spots or overspraying, even if different nozzles are used that have different spray patterns. It also includes an arrangement that prevents dripping.

Generally, the apparatus is used to apply paint to a surface, but it could be used to apply other fluids, such as polyurethane, wood stain, adhesives and the like.

DETAILED DESCRIPTION

Figure 1:
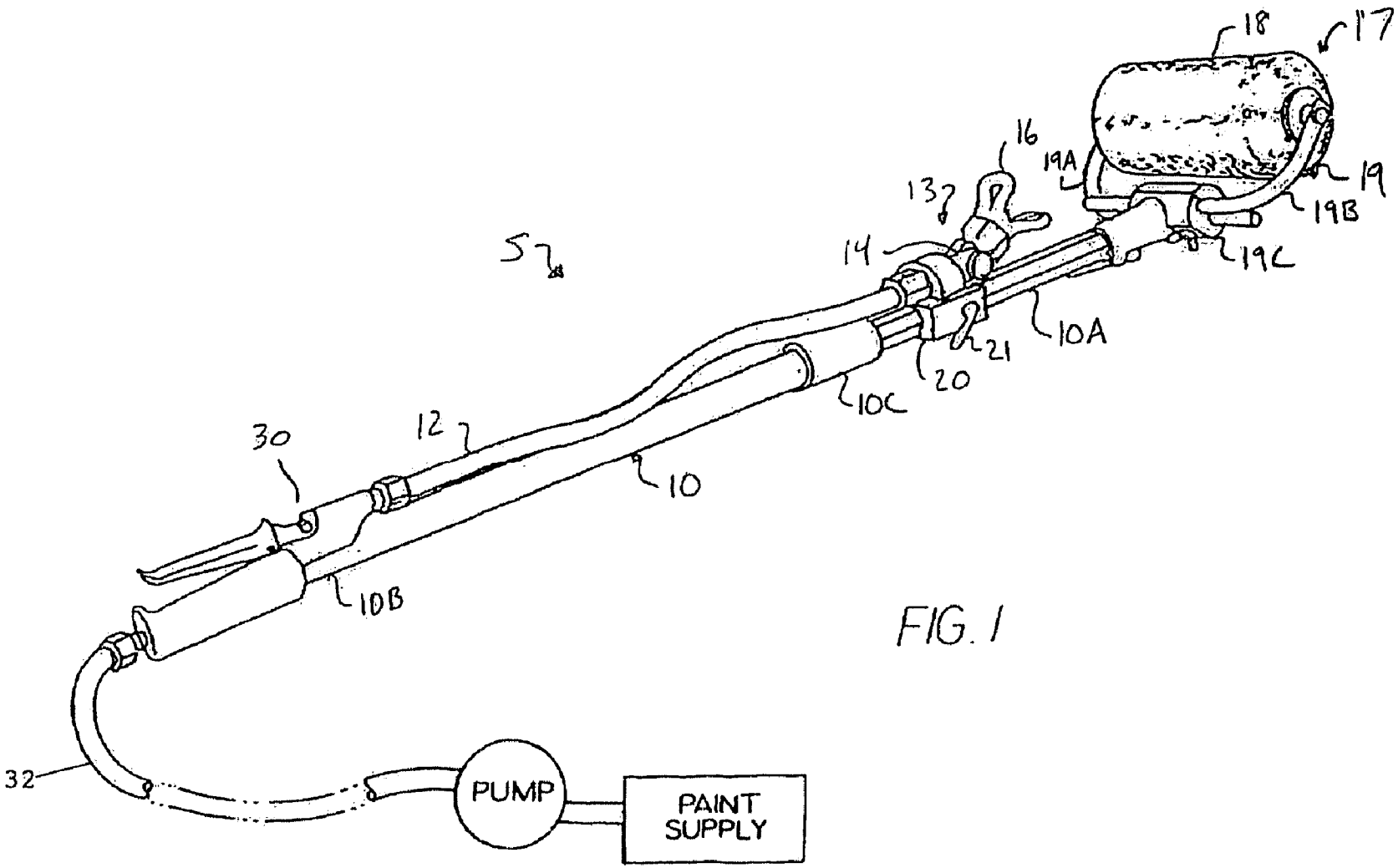
FIG. 1 is a perspective view of an apparatus for applying fluid to a surface made in accordance with the present invention.

FIGS. 1-4 show one embodiment of a painting apparatus 5 made in accordance with the present invention. The apparatus 5 includes a pole 10 having a first end 10A and a second end 10B, with a conduit 12 (in this case the conduit is a hose) extending from the first end 10A of the pole 10 to the second end 10B. In this embodiment, the pole is telescoping and has a tightening collar 10C that secures the two telescoping parts together. At the first end 10A of the pole 10, the hose 12 is connected go a spray nozzle assembly 13, including a shut-off valve 14 and a spray nozzle 16. The details of the spray nozzle assembly 13 are shown in U.S. Pat. No. 6,619,569, which is hereby incorporated herein by reference. Also at the first end 10A of the pole 10, beyond the nozzle assembly 13, is a roller assembly 17, which is secured to the end of the pole with a press fit, by threading it onto the end of the pole, or by means of set screws, all of which are well known in the art. The roller assembly 17 is described in more detail below.

At the second end 10B of the pole 10, the hose 12 is connected to a manually-operated valve 30, which controls the flow of paint (or other fluid) to the spray nozzle 16 as will be explained in greater detail later.

Figures 3, 3A:
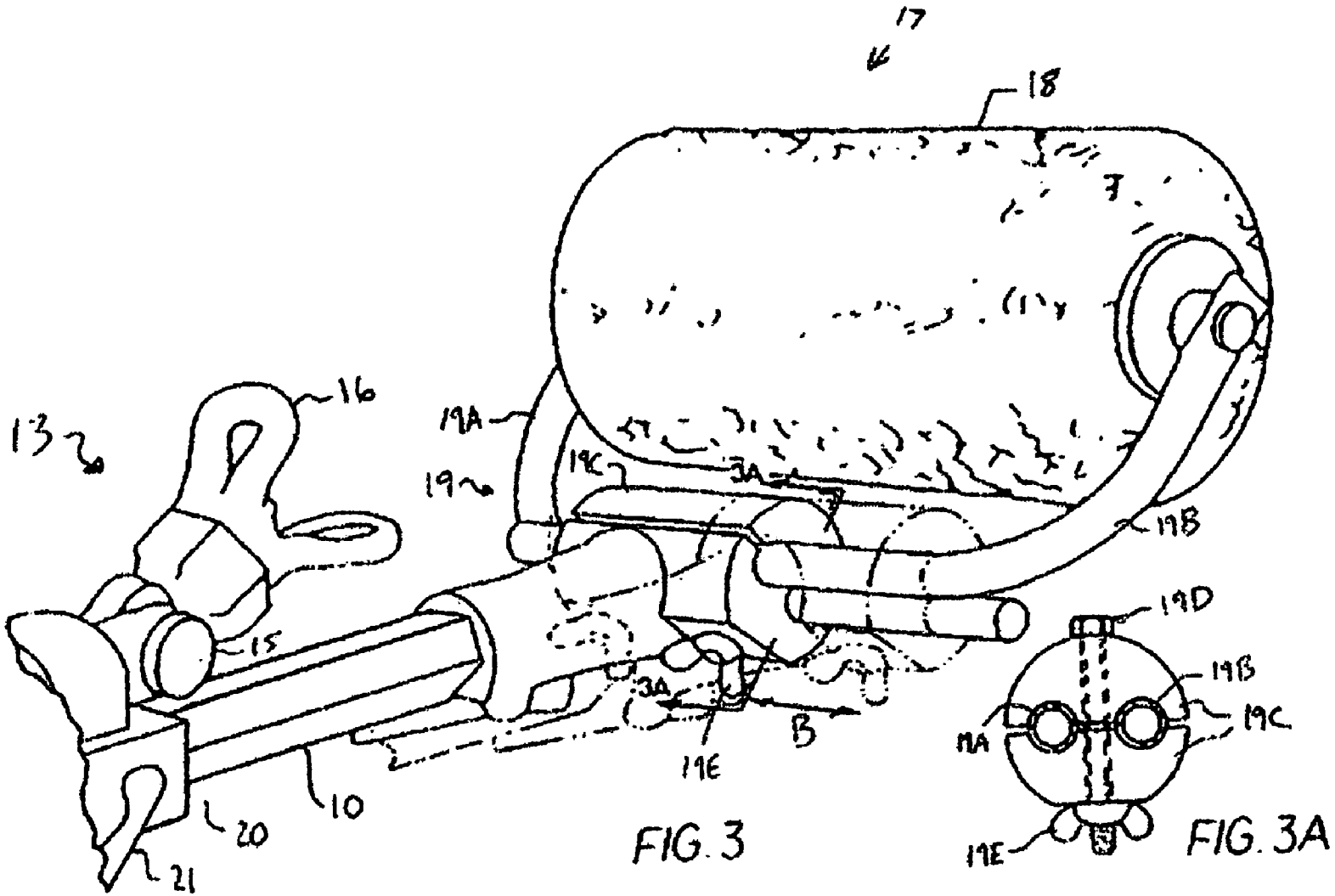
FIG. 3 is another broken away enlarged view of the end of the apparatus of FIG. 1, showing that the roller assembly is laterally adjustable relative to the spray nozzle assembly.
FIG. 3A is view taken along line 3A-3A in FIG. 3 detailing the tightening mechanism of the roller assembly.

As best shown in FIG. 3, the roller assembly 17 includes a replaceable roller 18 and a frame 19. In this case, the frame 19 has first and second adjustable support arms 19A, 19B coupled with a base 19C to allow the same frame 19 to be used with rollers of different widths, as well as to allow lateral movement of the roller 18 relative to the nozzle assembly 13. As shown in FIG. 3A, the base 19C includes two separate pieces that are held together by one or more bolts 19D. A wingnut 19E is used with each bolt 19D to tighten the two pieces of the base 19C together and clamp around the support arms 19A, 19B. Thus the support arms 19A, 19B are locked into place by tightening the wingnuts 19E against the base 19C, and the support arms 19A, 19B can be moved by loosening the wingnuts 19E until the support arms can slide freely in the base 19C.

To use a wide roller with the frame 19, both support arms 19A, 19B are pulled laterally outwardly away from the base 19C. To use a narrow roller with the frame 19, both support arms 19A, 19B are pushed laterally inwardly toward the base 19C. Moving both support arms 19A, 19B in the same direction moves the roller 18 laterally in relation to the spray nozzle assembly 13 (as denoted by arrow B in FIG. 3). So, for instance, the roller 18 can be shifted to the left relative to the longitudinal axis of the pole and relative to the spray nozzle assembly by loosening the wing nut 19E, shifting the support arms 19A, 19B to the left, and retightening the wing nut 19E, as shown in phantom view in FIG. 3. In general, the goal would be to align the spray nozzle 16 with the center of the roller 18, so the spray nozzle 16 sprays across the entire width of the roller 18 without overspraying.

The roller frame shown in FIGS. 1, 3 and 3A is a SHERLOCK® WIDE BOY™ made by The Wooster Brush Company, but other adjustable or non-adjustable roller frames could be used as well. It should be noted that the roller assembly can readily be removed from the pole if desired, leaving an extendable pole with a spray nozzle for spraying directly onto the surface to be coated.

Figure 2:
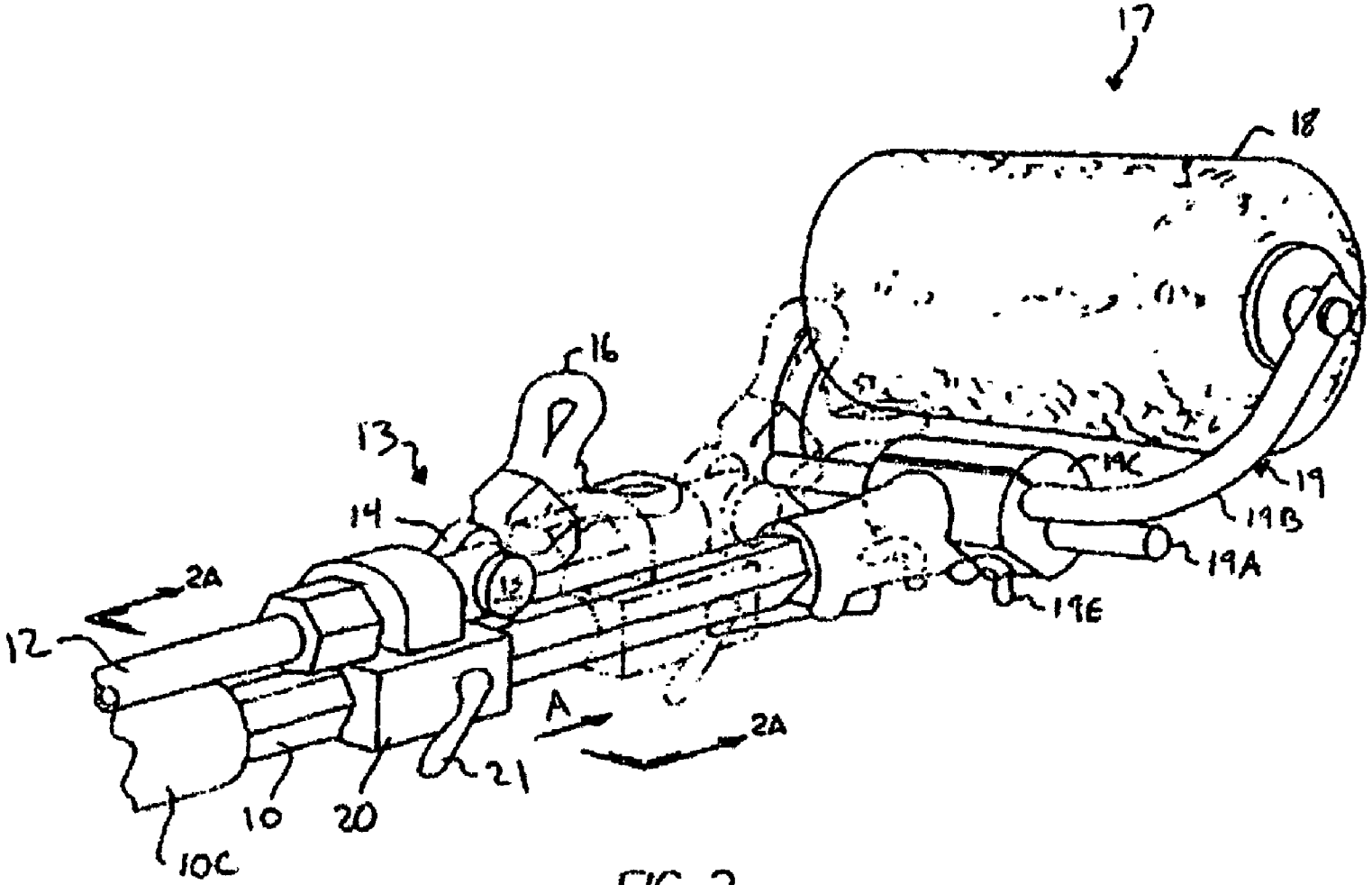
FIG. 2 is a broken away enlarged view of one end of the apparatus of FIG. 1 showing that the spray nozzle assembly is longitudinally adjustable relative to the roller assembly.

As best shown in FIG. 2, the spray nozzle assembly 13 in this embodiment is secured to the pole 10 by a mounting bracket 20 that clamps to the pole using a lever arm 21. The longitudinal distance between the spray nozzle assembly 13 and the roller assembly 17 is adjusted by rotating the lever arm 21 to unclamp it from the pole, sliding the bracket 20 longitudinally along the length of the pole 10, and then rotating the lever arm 21 to clamp it onto the pole 10 in the new position. FIG. 2 shows the bracket 20 and nozzle assembly 13 in a first position in solid lines and in a second position in phantom, with the nozzle 16 located closer to the roller 18. To go from the first position to the second position, the bracket 20 and nozzle assembly 13 were moved in the direction of arrow A, thus changing the longitudinal distance between the roller 18 of the roller assembly 17 and the spray nozzle 16 of the spray nozzle assembly 13, while maintaining their relative lateral positions.

It is generally desirable for the spray nozzle 16 to spray paint (or other fluid) uniformly across the width of the roller 18 without going past the edges of the roller 18. As there are varying sizes and designs of spray nozzles 16 and rollers 18, and the nozzle 16 and roller 18 can readily be replaced, the ability to adjust the relative longitudinal positions between the spray nozzle and the roller helps ensure that the roller is properly coated regardless of the nozzle or roller used. So, for instance, if a painter changes to a wider or narrower roller, or if he changes to a nozzle with a wider or narrower spray pattern, he may adjust for the change by rotating the lever arm 21 to loosen the bracket 20 and slide the spray nozzle assembly 13 closer to or farther away from the roller assembly 17 to provide for proper coverage of the roller 18 by the spray nozzle 16.

Figure 2A:
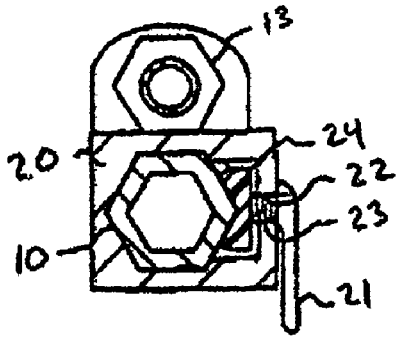
FIG. 2A is a view taken along line 2A-2A in FIG. 2 detailing the tightening mechanism of the spray nozzle mounting bracket.

FIG. 2A provides a detailed view of the tightening mechanism for the mounting bracket 20 and lever 21 shown in FIG. 2. The bracket has a threaded hole 22, and the lever arm 21 has a screw portion 23 threadingly engaged with the hole 22. A clamping pad 24 is located inside the bracket 20, trapped between the pole 10 and the screw portion 23 of the lever arm 21. Turning the lever arm 21 clockwise threads the screw 23 into the hole 22, pushes the clamping pad 24 against the side of the pole 10, and fixes the mounting bracket 20 (and spray nozzle assembly 13) relative to the pole 10. The clamping pad 24 is generally made of a pliable material, such as rubber, to provide friction between the pad 24 and the pole 10 to prevent sliding. Turning the lever arm 21 counter-clockwise releases the pressure against the clamping pad 24, unlocking the bracket 20, and allowing the bracket 20 (and spray nozzle assembly 13) to slide longitudinally along the pole 10.

Figure 2B:
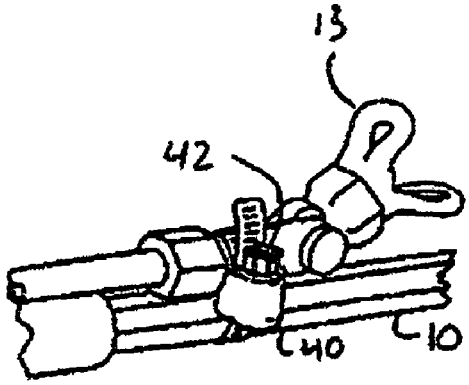
FIG. 2B is a broken away perspective view of an alternative tightening mechanism for the spray nozzle assembly.

FIGS. 2B-2E are examples of alternative ways that the spray nozzle assembly could be secured to the pole to provide means for adjusting the longitudinal distance between the spray nozzle and the roller. In FIG. 2B, an ordinary hose clamp 40 is used to secure the spray nozzle assembly 13 to the pole 10. A screw 42 on the hose clamp 40 tightens or loosens the hose clamp 40 around the pole 10 and nozzle assembly 13. To move the nozzle assembly 13, a user would loosen the screw 42 of the hose clamp with a screwdriver, slide the nozzle assembly 13 along the pole 10, and then tighten the screw 42 to fasten the nozzle assembly 13 to the pole 10.

Figure 2C:
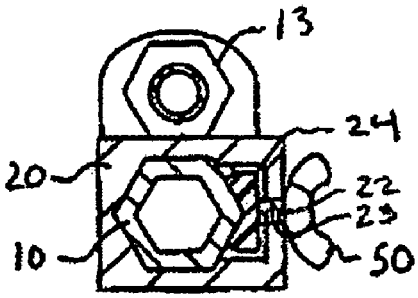
FIG. 2C is an alternative tightening mechanism for the spray nozzle mounting bracket shown in FIG. 2A.

FIG. 2C is identical to FIG. 2A except that the lever arm has been replaced by a threaded bolt 50 having a wing head. Turning the bolt 50 in one direction tightens the clamping pad 24 against the pole 10.

Figure 2D:
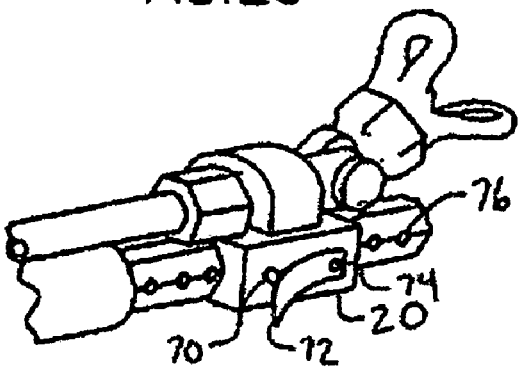
FIG. 2D is still another alternative tightening mechanism for the spray nozzle mounting bracket shown in FIG. 2A.

FIG. 2D shows another alternative for securing the mounting bracket 20 to the pole 10. In this case, the mounting bracket 20 has an unthreaded hole which receives a pin 70 secured to a flexible tab 72. The flexible tab 72 is secured to the mounting bracket with a screw 74 which creates a spring force biasing the pin 70 towards the hole in the mounting bracket. The pin 70 is long enough to extend completely through the hole in the mounting bracket 20 whenever the tab 72 is in the "closed" position (the closed position being when the tab 72 is flush against the side of the bracket 20). The pole 10 has a series of holes 76 in alignment with the pin 70 on the mounting bracket so that the pin 70 in the closed position extends into one of the holes 76 on the pole 10, fixing the mounting bracket 20 relative to the pole. When the tab 72 is lifted up away from the bracket 20 to the "open" position (as shown in FIG. 2D), the pin 70 disengages from the hole 76 in the pole 10, and the bracket may be slid along the pole 10. The bracket 20 may then be lined up with a different hole 76, and, when the tab 72 is released, it springs back to the closed position and locks the bracket 20 in place.

Figure 2E:
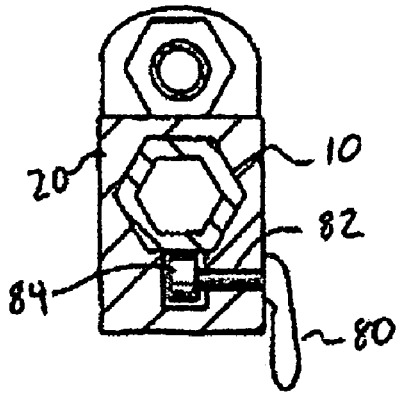
FIG. 2E is still another alternative tightening mechanism for the spray nozzle mounting bracket shown in FIG. 2A.

FIG. 2E shows yet another alternative for securing the mounting bracket 20 to the pole 10. Here, a lever arm 80 is secured to a shaft 82 which is secured to a cam 84. In the closed position shown in FIG. 2E, the cam 84 is pressing against the pole 10 to fix the bracket 20 relative to the pole 10. Turning the lever arm 80 rotates the cam 84. Once the lever 80 is rotated so that the cam 84 is no longer pressing against the pole 10, the lever arm is in the open position and the mounting bracket 20 may be repositioned along the pole 10. The aforementioned mechanisms are provided as examples only, and other known means for adjusting the longitudinal position of the spray nozzle assembly could alternatively be used.

The spray nozzle assembly 13 includes a single spray nozzle 16 and a shut-off valve 14 which helps prevent paint in the hose 12 from dripping through the spray nozzle 16. U.S. Pat. No. 6,619,569 shows the valve 14 that is used in this embodiment. The valve requires a certain pressure level in the line 12 in order to open and allow paint to be sprayed through the nozzle 16. When the required pressure level is not present in the line 12, the valve 14 closes. The desired pressure set point may be manually adjusted.

The shut-off valve 14 works in conjunction with a manually-operated valve 30 connected upstream of the hose 12 at the second end 10B of the pole 10. The manually-operated valve 30 is connected to a paint supply hose 32 which leads to the pump and paint supply shown in FIG. 1. The pump feeds paint from the paint bucket, through the paint supply hose 32, to the manually-operated valve 30, which, in turn, controls the flow of paint through the hose 12 to the shut-off valve 14 and spray nozzle 16. When the manually-operated valve 30 is closed, it stops the flow of paint into the hose 12, so, as the paint (or other fluid) sprays out the nozzle 16, the pressure in the hose 12 drops, and the shut-off valve 14 closes. When the manually-operated valve 30 is opened, the pressure in the hose 12 increases above the set point at the automatic shut-off valve 14, causing the automatic shut-off valve 14 to open. In this case, the manually-operated valve 30 is a trigger type or lever arm type valve, which is commonly used in the art.

This configuration using the manually-operated valve 30 and the pressure-controlled automatic shut-off valve 14 helps prevent the problem of dripping paint. Either there is sufficient pressure in the hose 12 to provide a good spray out the spray nozzle 16, or the automatic shut-off valve 14 closes and prevents any fluid from leaving the spray nozzle 16. Although this embodiment describes a pressure-sensitive shut-off valve working in conjunction with a manually-operated valve, other configurations could also be used. For instance, the shut-off valve could be mechanically linked to the manually-operated valve.

Figure 4:
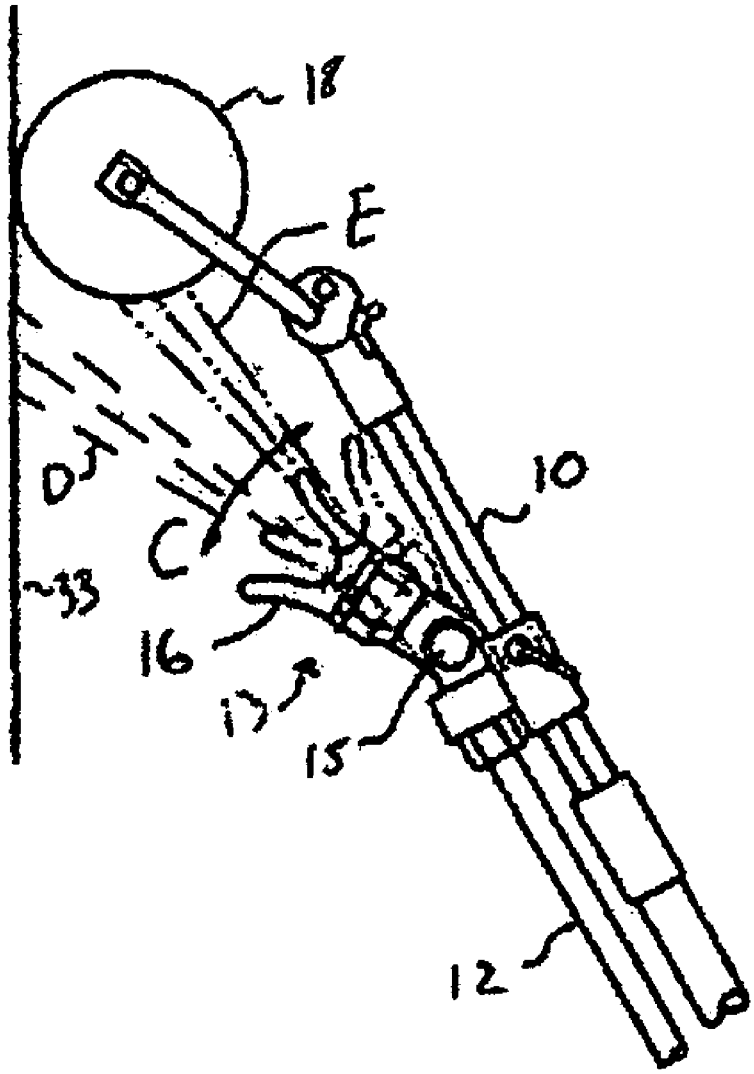
FIG. 4 is a broken away side view of the apparatus of FIG. 1 showing that the spray nozzle assembly is pivotable.

As best shown in FIG. 4, the spray nozzle assembly 13 permits the spray nozzle 16 to be pivoted manually relative to the pole 10 about a pivot axis defined by pivot axis 15. In this case, the spray nozzle assembly 13 has pivot positions including a first position that sprays fluid onto the roller 18 and a second position shown in phantom that sprays fluid directly onto the surface 33 to be painted. The two positions allow a painter to quickly switch between spraying directly onto the surface 33 to be painted and using the roller 18, simply by pushing the spray nozzle into the desired position. An arrow C denotes the pivot motion of the spray nozzle 16. Solid lines show the position of the nozzle and the path D of the fluid when it is spraying directly onto the wall, and phantom lines show the position of the nozzle and the fluid path E when the fluid is being sprayed onto the roller. A painter would typically spray directly onto the wall to cut in edges and corners or to paint trim, and would then simply flip the nozzle to the first position to spray onto the roller and roll paint onto the walls or other large flat surfaces. In this embodiment, the spray nozzle 16 is simply pivoted into the desired position by hand, without requiring the use of a wrench or other device. This makes it very easy for the painter to quickly change from one position to another.

Figure 5:
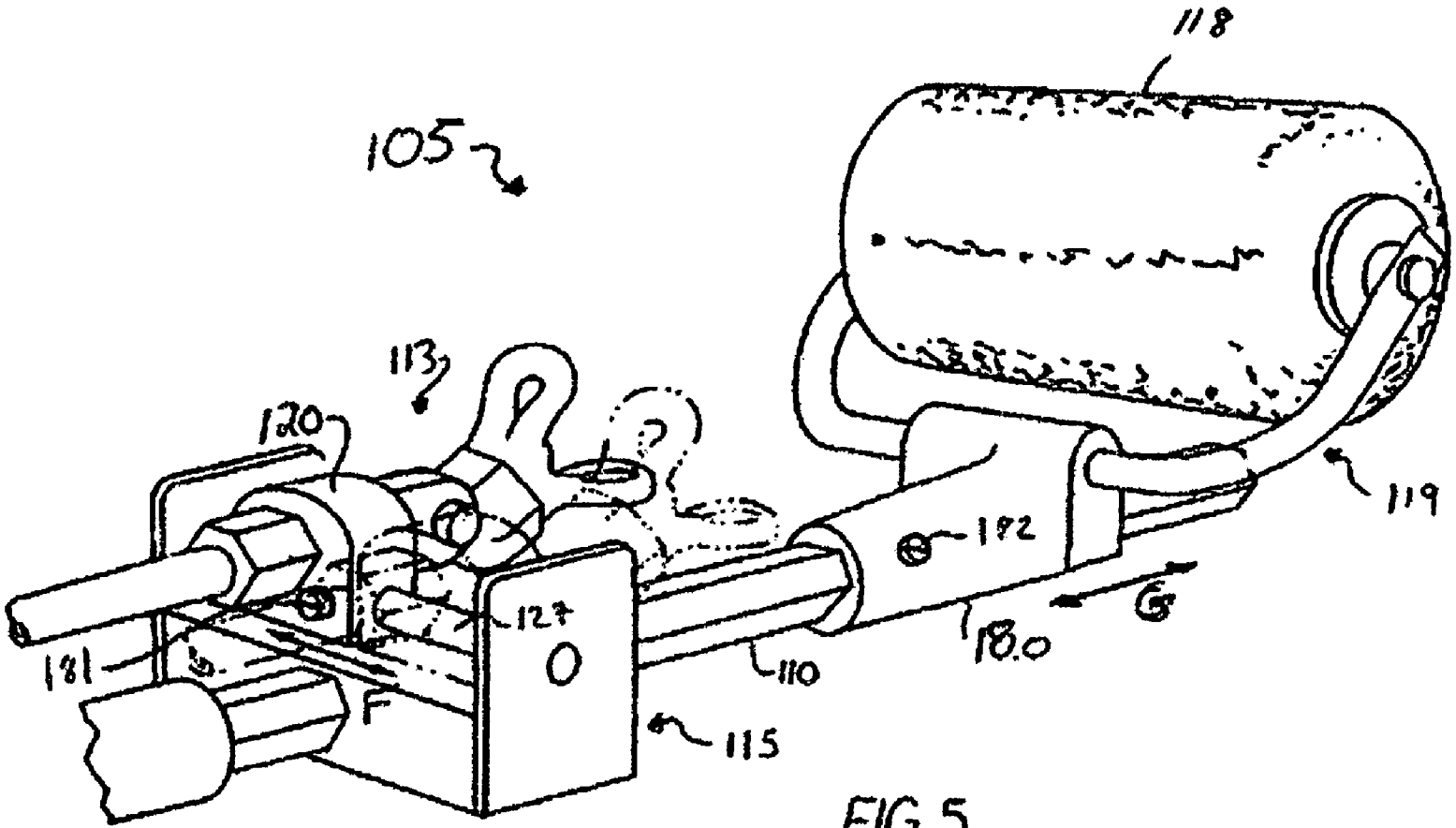
FIG. 5 is a broken away enlarged view of one end of another embodiment of an apparatus for applying fluid to a surface made in accordance with the present invention.

FIG. 5 shows another embodiment of a painting apparatus 105 made in accordance with the present invention. In this case, the painting apparatus 105 has a spray nozzle frame 115 that allows for lateral movement of the spray nozzle assembly 113 relative to the longitudinal axis of the pole and relative to the roller assembly 119 (as denoted by arrow F) and a roller mounting bracket 180 that allows for longitudinal movement of the roller assembly 119 along the pole 110 (as denoted by arrow G). Thus, in this embodiment, the relative lateral positions of the spray nozzle assembly 113 and the roller assembly 119 may be adjusted by moving the spray nozzle assembly 113 laterally relative to the pole, and the longitudinal distance between the spray nozzle assembly 113 and the roller assembly 119 may be adjusted by moving the roller assembly 119 longitudinally relative to the pole. (It is clear from the foregoing embodiments that the relative lateral and longitudinal positions of the spray nozzle and roller may be adjusted by moving either the nozzle or the roller or both relative to the pole.)

The spray nozzle frame 115 includes a support rod 127 running parallel to the axis of the roller 118 (perpendicular to the longitudinal axis of the pole) to facilitate the lateral movement of the spray nozzle assembly 113. The spray nozzle assembly 113 is mounted on the support rod 127 by a mounting bracket 120 similar to the mounting bracket 20 of the previous embodiment. In this particular embodiment, the mounting bracket 120 is fixed to the support rod 127 by tightening a screw 181. However, alternative means for releasably fixing the bracket 120 to the support rod 127, such as those shown and described in FIGS. 2A-2E may be used. Loosening the screw 181 allows the mounting bracket 120 to be slid along the support rod 127.

Unlike the previous embodiments, in this case the roller mounting bracket 180 can be moved lengthwise along the pole 110. A screw 182 is also used to fix the roller mounting bracket 180 and the roller mounting assembly 119 to the pole 110. Again, alternative mounting means could be used here, as well.

It will be obvious to those skilled in the art that modifications may be made to the embodiments described above without departing from the scope of the invention.

What is claimed is:

1. An apparatus for applying a fluid to a surface such as a wall, comprising:

a pole having first and second ends and defining a longitudinal axis;

a roller assembly attached adjacent to said first end, said roller assembly including a roller frame and a roller defining a roller axis extending in a lateral direction;

a spray nozzle mounted on said pole adjacent to said first end and manually pivotable to a first position in which the nozzle sprays onto said roller and to a second position in which the nozzle sprays directly onto the surface;

an automatic shutoff valve adjacent to and in fluid communication with said spray nozzle;

a conduit in fluid communication with said automatic shutoff valve;

a manually-operated valve adjacent to said second end and in fluid communication with said conduit; and means for adjusting the longitudinal position of at least one of said spray nozzle and said roller relative to said pole in order to adjust the longitudinal distance between said spray nozzle and said roller while maintaining their relative lateral positions.

2. An apparatus for applying a fluid to a surface as recited in claim 1, and further comprising:

means for adjusting the relative lateral position of said spray nozzle and said roller.

3. An apparatus for applying a fluid to a surface such as a wall, comprising:

a pole having first and second ends and defining a longitudinal axis;

a roller assembly attached adjacent to said first end, said roller assembly including a roller frame and a roller defining a roller axis extending in a lateral direction;

a spray nozzle mounted on said pole adjacent to said first end and manually pivotable to a first position in which the nozzle sprays onto said roller and to a second position in which the nozzle sprays directly onto the surface;

an automatic shutoff valve adjacent to and in fluid communication with said spray nozzle;

a conduit in fluid communication with said automatic shutoff valve;

a manually-operated valve adjacent to said second end and in fluid communication with said conduit;

means for adjusting the longitudinal mounting position of at least one of said spray nozzle and said roller on said pole in order to adjust the longitudinal distance between said spray nozzle and said roller; and means for adjusting the relative lateral position of said spray nozzle and said roller which includes means for adjusting the lateral position of said roller frame relative to the longitudinal axis of said pole.

4. An apparatus for applying a fluid to a surface as recited in claim 2, wherein said means for adjusting the relative lateral position includes means for adjusting the lateral position of said nozzle relative to the longitudinal axis of said pole.

5. An apparatus for applying a fluid to a surface as recited in claim 1, wherein said automatic shut-off valve is controlled by the pressure in said conduit, opening when the pressure in said conduit exceeds a set point and closing when the pressure in said conduit drops below said set point.

6. An apparatus for applying a fluid to a surface as recited in claim 5, wherein said conduit is a hose and said manually-operated valve is a lever arm valve.

7. An apparatus for applying a fluid to a surface as recited in claim 1, including means for adjusting the length of said pole.

* * * * *